US012378717B2

(12) United States Patent
Yoo et al.

(10) Patent No.: US 12,378,717 B2
(45) Date of Patent: Aug. 5, 2025

(54) DRYER AND METHOD FOR CONTROLLING THE SAME

(71) Applicant: Samsung Electronics Co., Ltd., Suwon-si (KR)

(72) Inventors: Sangoh Yoo, Suwon-si (KR); Hyejoon Seok, Suwon-si (KR); Hyungwoo Lee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 781 days.

(21) Appl. No.: 17/708,755

(22) Filed: Mar. 30, 2022

(65) Prior Publication Data

US 2022/0220662 A1 Jul. 14, 2022

Related U.S. Application Data

(63) Continuation of application No. PCT/KR2021/005115, filed on Apr. 22, 2021.

(30) Foreign Application Priority Data

Apr. 22, 2020 (KR) ..... 10-2020-0048804
Apr. 22, 2021 (KR) ..... 10-2021-0052282

(51) Int. Cl.
*D06F 58/46* (2020.01)
*D06F 34/04* (2020.01)
(Continued)

(52) U.S. Cl.
CPC ..... *D06F 58/46* (2020.02); *D06F 34/04* (2020.02); *D06F 34/06* (2020.02); *D06F 34/18* (2020.02);
(Continued)

(58) Field of Classification Search
CPC ..... D06F 58/46; D06F 34/04; D06F 34/06; D06F 34/18; D06F 34/28; D06F 58/206;
(Continued)

(56) References Cited

U.S. PATENT DOCUMENTS 4,738,034 A * 4/1988 Muramatsu ..... D06F 58/46 34/550
2008/0041115 A1* 2/2008 Kanazawa ..... D06F 34/18 68/12.04
(Continued)

FOREIGN PATENT DOCUMENTS

JP 2012-196393 10/2012
JP 2013-128637 A 7/2013
(Continued)

OTHER PUBLICATIONS

International Search Report for International Application No. PCT/KR2021/005115 dated Aug. 6, 2021.
International Written Opinion for International Application No. PCT/KR2021/005115 dated Aug. 6, 2021.

*Primary Examiner* — John P McCormack
(74) *Attorney, Agent, or Firm* — STAAS & HALSEY LLP

(57) ABSTRACT

A dryer including a main body which includes a user interface; a drum to accommodate a material to be dried; a motor configured to provide a rotation force to the drum; a heat pump device including a compressor, and configured to heat air to be supplied to the drum; an electrode sensor configured to output a pulse when contacting the drying material; a current sensor configured to output a sensed value corresponding to a magnitude of current flowing through the motor; and a controller configured to receive a drying course selected through the user interface, and output a control signal to control the motor and the compressor.

15 Claims, 14 Drawing Sheets

(51) Int. Cl.

| | |
|---|---|
| ***D06F 34/06*** | (2020.01) |
| ***D06F 34/18*** | (2020.01) |
| ***D06F 34/28*** | (2020.01) |
| ***D06F 58/20*** | (2006.01) |
| ***D06F 58/38*** | (2020.01) |
| *D06F 103/06* | (2020.01) |
| *D06F 103/08* | (2020.01) |
| *D06F 105/46* | (2020.01) |
| *D06F 105/56* | (2020.01) |
| *D06F 105/58* | (2020.01) |

(52) U.S. Cl.
CPC ..... *D06F 34/28* (2020.02); *D06F 58/206* (2013.01); *D06F 58/38* (2020.02); *D06F 2103/06* (2020.02); *D06F 2103/08* (2020.02); *D06F 2105/46* (2020.02); *D06F 2105/56* (2020.02); *D06F 2105/58* (2020.02)

(58) Field of Classification Search
CPC .. D06F 58/38; D06F 2103/06; D06F 2103/08; D06F 2105/46; D06F 2105/56; D06F 2105/58; D06F 2103/46
USPC ..... 34/486
See application file for complete search history.

(56) References Cited

U.S. PATENT DOCUMENTS

| | | | | |
|---|---|---|---|---|
| 2018/0087209 | A1* | 3/2018 | Lee | D06F 33/00 |
| 2019/0390392 | A1* | 12/2019 | Lee | D06F 34/18 |

FOREIGN PATENT DOCUMENTS

| | | | | |
|---|---|---|---|---|
| JP | 2014-33839 | | | 2/2014 |
| JP | 2014-150978 | | | 8/2014 |
| KR | 1999-0062394 | | | 7/1999 |
| KR | 10-0304874 | | | 9/2001 |
| KR | 10-0381191 | | | 4/2003 |
| KR | 10-2011-0023061 | | | 3/2011 |
| KR | 10-1052778 | B1 | | 8/2011 |
| KR | 10-1064017 | B1 | | 9/2011 |
| KR | 10-1138139 | B1 | | 4/2012 |
| KR | 10-1456208 | B1 | | 11/2014 |
| KR | 10-1704421 | B1 | | 2/2017 |
| KR | 10-2019-0065151 | A | | 6/2019 |
| KR | 10-2019-0121586 | A | | 10/2019 |
| KR | 10-2019-0143317 | | | 12/2019 |
| TW | 1697601 | B | * | 7/2020 |

* cited by examiner

| DEHYDRATION LEVEL | PERCENTAGE OF WATER CONTENT (COTTON) | PERCENTAGE OF WATER CONTENT (SYNTHETICS) |
|---|---|---|
| STRONGEST | 48% | 23% |
| STRONG | 55% | 31% |
| MEDIUM | 65% | 37% |
| WEAK | 85% | 48% |

FIG. 7

FIG. 10

| WEIGHT | ~1kg | 1~2kg | 2~3kg | 3~4kg | 4~5kg | 5~6kg | 6~7kg | 7~8kg | 8~9kg |
|---|---|---|---|---|---|---|---|---|---|
| SENSED VALUE OF CURRENT (LOAD) | BELOW 735 | BELOW 830 | BELOW 925 | BELOW 1020 | BELOW 1115 | BELOW 1210 | BELOW 1305 | BELOW 1400 | ABOVE 1400 |
| COTTON | −59 min | −44 min | −30 min | −20 min | +0 min (120) | +20 min | +45 min | +70 min | +115 min |
| SYNTHETICS | −59 min | −54 min | −50 min | −40 min | −10 min | +10 min | +55 min | +60 min | +105 min |

| KIND | SENSED TIME | CORRECTION FACTOR |
|---|---|---|
| COTTON | (39 < T <= 60) | 0.14 |
| | (60 < T <= 80) | 0.14 |
| | (80 < T <= 100) | 0.14 |
| | (100 < T <= 125) | 0.14 |
| | (125 < T <= 135) | 0.14 |
| | (135 < T <= 150) | 0.07 |
| | (150 < T) | 0.07 |
| SYNTHETICS | (39 < T <= 60) | 0.1 |
| | (60 < T <= 80) | 0.1 |
| | (80 < T <= 100) | 0.1 |
| | (100 < T <= 125) | 0.14 |
| | (125 < T <= 135) | 0.14 |
| | (135 < T <= 150) | 0.07 |
| | (150 < T) | 0.07 |

FIG. 12

DRYER AND METHOD FOR CONTROLLING THE SAME

CROSS-REFERENCE TO RELATED APPLICATION

This application is a continuation application, under 35 U.S.C. § 111(a), of International Patent Application No. PCT/KR2021/005115, filed Apr. 22, 2021, which claims the foreign priority benefit under 35 U.S.C. § 119 to Korean Patent Application No. 10-2020-048804, filed on Apr. 22, 2020 and Korean Patent Application No. 10-2021-0052282, filed on Apr. 22, 2021, in the Korean Intellectual Property Office, the disclosures of each of which are incorporated by reference herein in its entirety.

FIELD

The present disclosure relates to a dryer, and more particularly, to a dryer capable of determining a fiber composition of clothes to be dried, estimating an operation time based on a result of the determining, and displaying the operation time, and a method for controlling the dryer.

DESCRIPTION OF THE RELATED ART

A dryer is an appliance that supplies hot air to the inside of the drum accommodating wet clothes (hereinafter, referred to as a drying material) to be dried, while rotating the drum, to dry the drying material.

In general, an operation time of a dryer is set according to a course selected by a user, and the kind of a drying material is not considered in setting the operation time.

However, an actual drying time taken until a drying material is dried depends on the kind of the drying material. For example, cotton fibers require a longer drying time than synthetic fibers. Accordingly, when a uniform drying time is applied, like typical cases, insufficient drying or excessive drying occurs, which may cause wasted energy or damages of drying materials.

SUMMARY

A dryer according to one aspect of the present disclosure includes: a main body including a user interface; a drum to accommodate a material to be dried; a motor configured to provide a rotation force to the drum; a heat pump device including a compressor, and configured to heat air to be supplied to the drum; an electrode sensor configured to output a pulse when in contact with the material to be dried; a current sensor configured to output a sensed value corresponding to a magnitude of current flowing through the motor; and a controller configured to receive a drying course selected through the user interface, and output a control signal to control the motor and the compressor. According to an aspect of the present disclosure, the controller calculates an estimated time for the selected drying course to be completed, based on a pulse received from the electrode sensor and a sensed value received from the current sensor, while controlling the drum to rotate without driving the compressor, and controls the display to display the estimated time.

The controller may control the user interface to display the estimated time when the drum stops rotating.

The controller may identify a type of the material to be dried based on a number of pulses received from the electrode sensor, and display information about the type of the material to be dried on the display.

The controller controls the motor to rotate the drum in a first direction, and controller may control, after the estimated time is displayed, the drum to rotate in a second direction that is opposite to the first direction.

The controller may display the estimated time when a preset time elapses from when the drum starts rotating.

The controller may drive the compressor after the estimated time is displayed.

The controller may drive the compressor when a preset time elapses after the drum starts rotating in the second direction.

The controller may control the driver such that revolutions per minute (rpm) of the drum when the drum rotates in the second direction is greater than rpm of the drum when the drum rotates in the first direction.

The dryer according to an embodiment may further include a communicator configured to communicate with an external server, wherein the controller may control the communicator to transmit the estimated time to the external server.

The controller may control the display to display the information about the type of the material to be dried together with the estimated time, when the estimated time is displayed.

A control method of a dryer according to one aspect of the present disclosure includes: receiving a request to start a drying operation corresponding to a drying course selected by a user; receiving, while a drum provided to accommodate a material to be dried rotates, a sensed value corresponding to current flowing through a motor for rotating the drum; counting, while the drum rotates, a number of pulses output through a contact to the material to be dried accommodated in the drum; calculating an estimated time for the selected drying operation to terminate, based on the received sensed value and the counted number of pulses; and displaying the estimated time.

The control method according to an embodiment may further include: identifying a type of the material to be dried based on the counted number of pluses; and displaying information about the type of the material to be dried.

The information about the type of the material to be dried may be displayed together with the estimated time.

The control method according to an embodiment may further include controlling, after the estimated time is displayed, the drum to rotate in a second direction that is opposite to the first direction.

The control method according to an embodiment may further include controlling the drum to stop rotating after the drum is controlled to rotate for a preset time, and displaying the estimated time when the drum stops.

The control method according to an embodiment may further include not driving the compressor of the dryer while the drum rotates in the first direction, and driving the compressor after the estimated time is displayed.

The control method according to an embodiment may further include driving the compressor of the dryer when a preset time elapses after the drum starts rotating in the second direction.

The controlling of the drum to rotate in the second direction that is opposite to the first direction may include controlling the drum such that rpm of the drum when the drum rotates in the second direction is greater than rpm of the drum when the drum rotates in the first direction.

The control method according to an embodiment may further include transmitting the estimated time to an external server.

Additional aspects of the disclosure will be set forth in part in the description which follows and, in part, will be obvious from the description, or may be learned by practice of the disclosure.

BRIEF DESCRIPTION OF THE DRAWINGS

These and/or other aspects of the disclosure will become apparent and more readily appreciated from the following description of the embodiments, taken in conjunction with the accompanying drawings of which:

FIG. 7 shows a correlation between kinds of drying materials and humidity of the drying materials.

FIG. 10 shows a look-up table about additional drying times according to weights and kinds of drying materials.

FIG. 12 shows a look-up table for calculating additional drying times.

DETAILED DESCRIPTION

Figure 1:
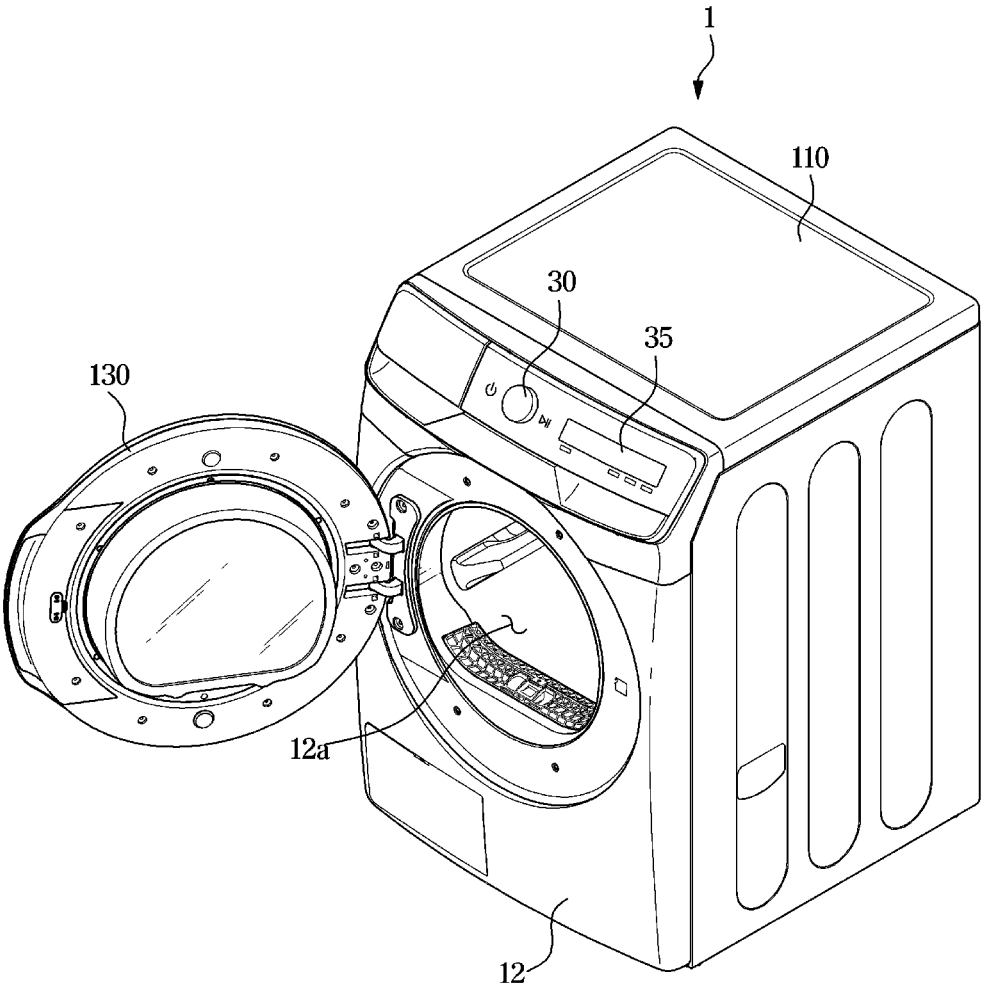
FIG. 1 shows an outer appearance of a dryer according to an embodiment.

Throughout this specification, like reference numerals will refer to like components. The present specification does not describe all elements of embodiments, and descriptions about content being general in the technical art to which the disclosure belongs or overlapping content between the embodiments will be omitted. As used herein, the terms "portion", "part, "module, "member" or "block" may be implemented as software or hardware, and according to embodiments, a plurality of "portions", "parts, "modules, "members" or "blocks" may be implemented as a single component, or a single "portion", "part, "module, "member" or "block" may include a plurality of components.

Through this specification, it will be understood that when a certain part is referred to as being "connected" to another part, it can be directly or indirectly connected to the other part. When a part is indirectly connected to another part, it may be connected to the other part through a wireless communication network.

Also, it will be understood that when a certain part "includes" a certain component, the part does not exclude another component but can further include another component, unless the context clearly dictates otherwise.

In the entire specification, it will also be understood that when an element is referred to as being "on" or "over" another element, it can be directly on the other element or intervening elements may also be present.

It will be understood that, although the terms "first", "second", etc., may be used herein to describe various elements, these elements should not be limited by these terms. The above terms are used only to distinguish one component from another.

An expression used in the singular encompasses the expression of the plural, unless it has a clearly different meaning in the context.

Reference numerals used in operations are provided for convenience of description, without describing the order of the operations, and the operations can be executed in a different order from the stated order unless a specific order is definitely specified in the context.

Hereinafter, embodiments of the disclosure will be described in detail with reference to the accompanying drawings.

The present disclosure is directed to providing a dryer capable of improving energy consumption efficiency and displaying more accurate information for a user by identifying a kind of material to be dried, determining an operation time of the dryer to which properties of the material to be dried are reflected, and providing the operation time to the user, and a method for controlling the dryer.

According to an aspect of the disclosure, an operation time of a dryer may be estimated by considering properties of material to be dried, and accurate information about a time at which an operation of the dryer is completed may be provided to a user.

Also, because a dryer according to an aspect of the disclosure operates according to an optimal drying time obtained by considering a kind of a drying material, a waste of energy and damages of drying materials may be prevented.

Figure 2A:
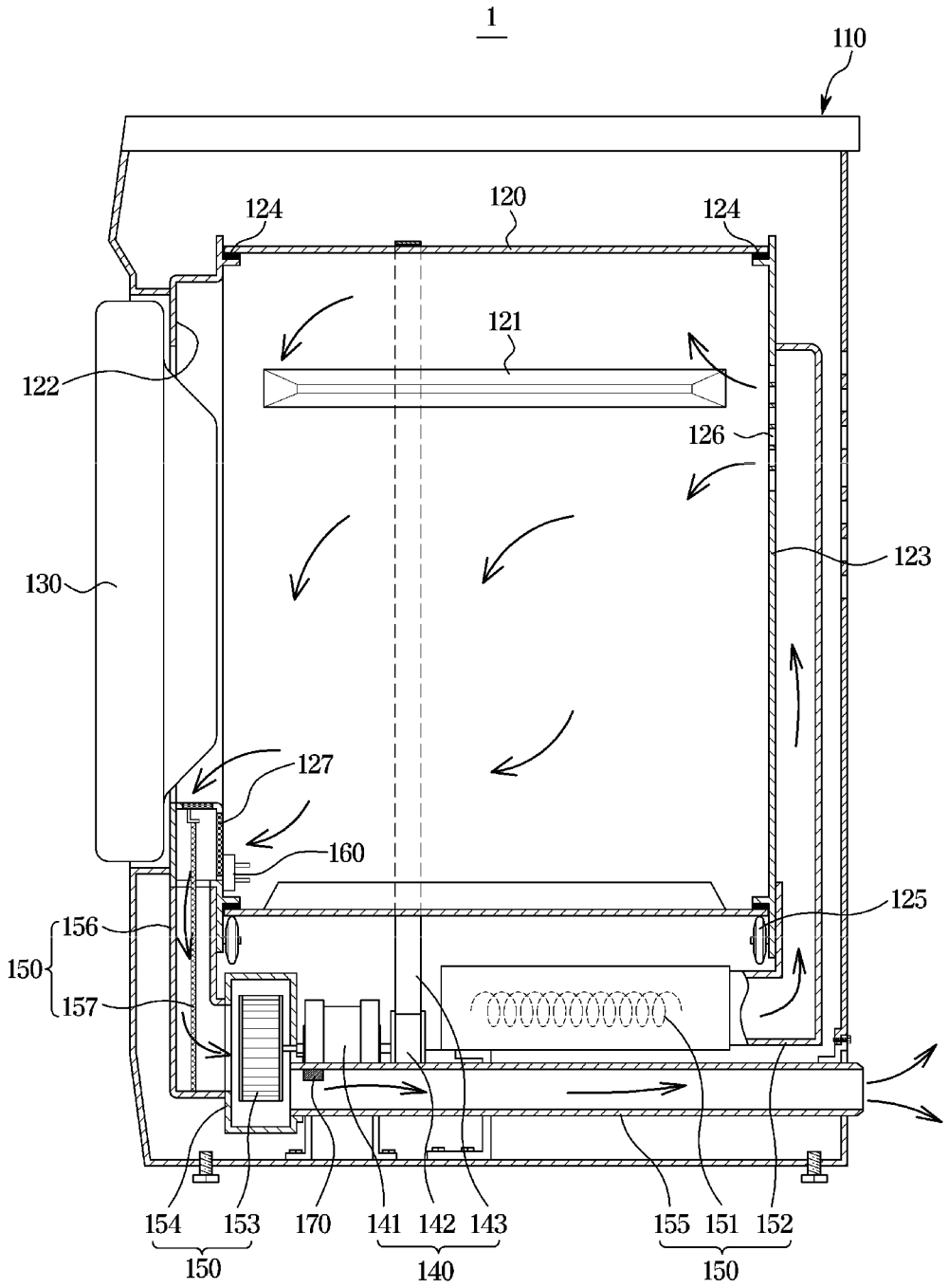
FIGS. 2A and 2B are side cross-sectional views of a dryer according to an embodiment.
Figure 2B:
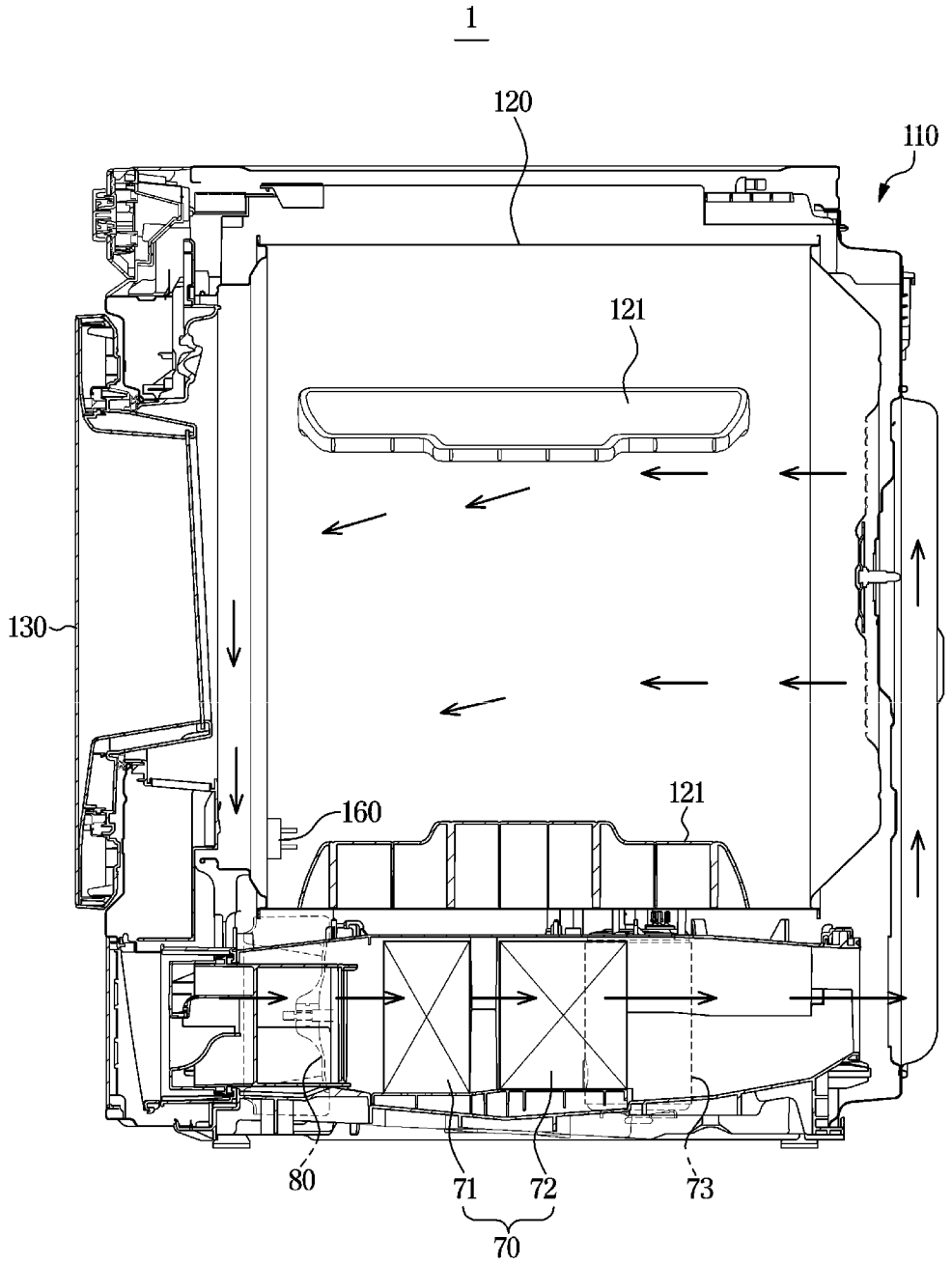

FIG. 1 shows an outer appearance of a dryer according to an embodiment, and FIGS. 2A and 2B are side cross-sectional views of a dryer according to an embodiment. FIG. 2A shows a dryer for directly heating air through a heater, and FIG. 2B shows a dryer of a heat pump type for collecting heat energy of outside air to supply warm air and dehumidifying at low temperature.

Referring together to FIGS. 1 and 2A, a dryer 1 according to an embodiment may include a main body 110 forming an outer appearance, a drum 120 which is rotatably installed inside the main body 110 and in which a drying material is accommodated, a door 130 for opening and closing the drum 120, a driving assembly 140 for rotating the drum 120, and a drying assembly 150 for drying an object (hereinafter, referred to as a 'drying material') to be dried, accommodated in the drum 120.

Referring together to FIGS. 1 and 2B, a dryer 1 according to an embodiment may include a heat pump device configured with an evaporator 71, a condenser 72, a compressor 73, etc., unlike the dryer 1 shown in FIG. 2A. The heat pump device may have a refrigerant circulation path connected from the compressor 73 to the condenser 72, an expansion valve, and the evaporator 73 and then again returning to the compressor 73, wherein the condenser 72 and the evaporator 71 function as a heat exchanger 70.

In a front cover 12, an opening 12*a* may be formed, and the door 130 for opening and closing the opening 12*a* may be rotatably installed on the front cover 12.

On an upper end of the front cover 12, an inputter 30 for receiving a user control command, and a display 35 for displaying various information about operations of the dryer 1 or a screen for guiding user inputs may be positioned.

The inputter 30 may be provided in a form of a jog shuttle or a dial to enable the user to grip and turn the inputter 30 or press the inputter 30 to input a control command. Alternatively, the inputter 30 may be provided in a form of a touch pad or a button to enable the user to touch or press the inputter 30 to input a control command. Also, the inputter 30 may include a start button 31 to which a control command for starting an operation of the dryer 1 is input.

The display 35 may be implemented by various display panels, such as a Liquid Crystal Display (LCD), Light Emitting Diodes (LED), Organic Light Emitting Diodes (OLED), or Quantum Light Emitting Diodes (QLED). Also, the display 35 may be implemented as a touch screen by including a touch pad on the front side.

The main body 110 may accommodate the drum 120, the driving assembly 140, and the drying assembly 150. In the front side of the main body 110, the opening 12*a* may be formed.

The drum 120 may be formed in a shape of a cylinder of which the front and rear sides open.

The drum 120 may rotate in a clockwise or counterclockwise direction inside the main body 110 by a driving force of the motor 141.

On an inner circumferential surface of the drum 120, a plurality of lifters 121 may be provided to tumble a drying material. The plurality of lifters 121 may protrude from the inner circumferential surface of the drum 120 to a center of the drum 120.

On the front and rear sides of the drum 120, a front support plate 122 and a rear support plate 123 may be provided respectively. The front side of the drum 120 may be covered by the front support plate 122 fixed to the front side of the main body 110, and the rear side of the drum 120 may be covered by the rear support plate 123 fixed to a rear side of the main body 110.

The front support plate 122 and the rear support plate 123 may rotatably support the drum 120.

To rotatably support the drum 120, a plurality of slide pads 124 for reducing friction resistance may be respectively positioned at a portion at which the front support plate 122 meets the drum 120 and a portion at which the rear support plate 123 meets the drum 120, and a plurality of rollers 125 for rotatably supporting the drum 120 may be respectively positioned below the front support plate 122 and the rear support plate 123. Accordingly, the drum 120 may smoothly rotate.

In the rear support plate 123 provided in the rear side of the drum 120, an intake opening 126 for inhaling hot air may be formed, and at a lower area of the drum 120, a flow path for condensing air containing moisture and again heating air from which water has been removed to supply the heated air to the drum 120 may be formed.

In the front support plate 122 provided in the front side of the drum 120, an electrode sensor 160 for detecting a dryness level of a drying material accommodated in the drum 120 may be provided. An operation method of the electrode sensor 160 will be described with reference to FIG. 3.

The electrode sensor 160 may output an electrical signal corresponding to a percentage of water content of the drying material accommodated in the drum 120. The percentage of water content is a value being proportional to an amount of water contained in the drying material, and has a greater value according to a higher degree of wetness of the drying material. Meanwhile, a percentage of water content is also expressed as a dryness level. In this case, a dryness level has a greater value according to a higher degree of dryness of a drying material. In the disclosure, the terms a percentage of water content and a dryness level may be used without distinction according to situations. A controller may determine a dryness level of the drying material based on the electrical signal received from the electrode sensor 160. The electrical signal may be a pulse signal, a current signal, or a voltage signal.

As shown in FIGS. 2A and 2B, the electrode sensor 160 may include two electrodes spaced at a preset interval.

Figure 3:
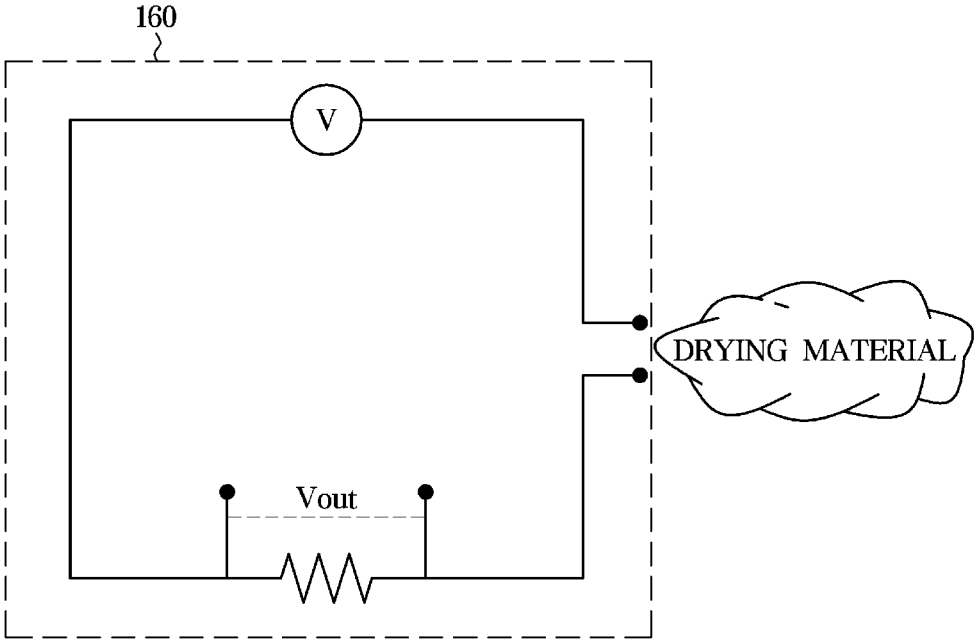
FIG. 3 is a view for describing a principle of an electrode sensor.

Referring to FIG. 3, when a drying material containing water contacts the two electrodes, a circuit of the electrode sensor 160 may be electrified and output an electrical signal. For example, when a direct current voltage of 12V is applied between the two electrodes, a drying material contacting the two electrodes may function as a resistor so that a voltage Vout being proportional to a percentage of water content of the drying material is measured at an output terminal. In other words, when the drying material has a high percentage of water content, a relatively high voltage may be output, and, when the drying material has a low percentage of water content, a relatively low voltage may be output. A process of determining a dryness level (or a percentage of water content) of a drying material based on a measurement voltage of the electrode sensor 160 will be described in more detail with reference to FIGS. 4 to 7.

The door 130 may be provided in the front side of the main body 110, and positioned at an entrance through which a drying material is put into or drawn from the drum 120. That is, the door 130 may open or close the entrance of the main body 110.

The driving assembly 140 may include a motor 141 installed at the lower area of the main body 110, a pulley 142 rotating by receiving power from the motor 141, and a belt 143 for rotating the drum 120 by rotating by a rotation of the pulley 142.

That is, the belt 143 may be wound around an outer surface of the pulley 141 and an outer surface of the drum 120, and accordingly, the pulley 142 may rotate according to driving of the motor 141 to rotate the drum 120.

A current sensor 170 may be positioned to one side of the motor 141 to sense current flowing through the motor 141, and the sensed current may be used to calculate a weight of a drying material accommodated in the drum 120. More specifically, the current sensor 170 may measure a magnitude of current flowing through the motor 141 upon driving of the motor 141, and a weight of a drying material may be calculated based on a load consumed by the drum 120 to rotate. Weight calculation based on the current sensor 170 will be described with reference to FIG. 5, later.

To supply hot air to the drum 120, the dryer 1 may include a heating device, and the heating device may correspond to an electrical heater or the condenser 72 of the heat pump device. The dryer 1 according to an embodiment of the disclosure may be a heat pump type including the evaporator 71, the condenser 72, the compressor 73, etc. Accordingly, the dryer 1 according to the current embodiment may use a refrigerant cycle to dry a drying material by a method of removing water from humid air exiting the drum 120 through the evaporator 71 and sending air heated through the condenser 72 to the drum 120 to circulate air.

A fan 153 according to an embodiment of the disclosure may receive a driving force from the motor 141 that provides a rotating force to the drum 120. In this case, the pulley 142 may be connected to one side of a shaft of the motor 141, and the fan 153 may be connected to the other side of the shaft of the motor 141.

As an alternative, the dryer 1 may further include another motor (not shown) for driving the fan 153. That is, a motor for a fan may be provided separately from the motor 141 for driving the drum 120.

A filter duct 156 may communicate with the inside of the drum 120 at one side, and the other side of the filter duct 156 may communicate with a fan case 154.

In the filter duct 156, a filter 157 for filtering various foreign materials included in air entered the filter duct 156 may be provided. That is, foreign materials, such as dust or lint, included in air discharged from an exhaust opening 127 may be filtered through the filter 157.

Figure 4:
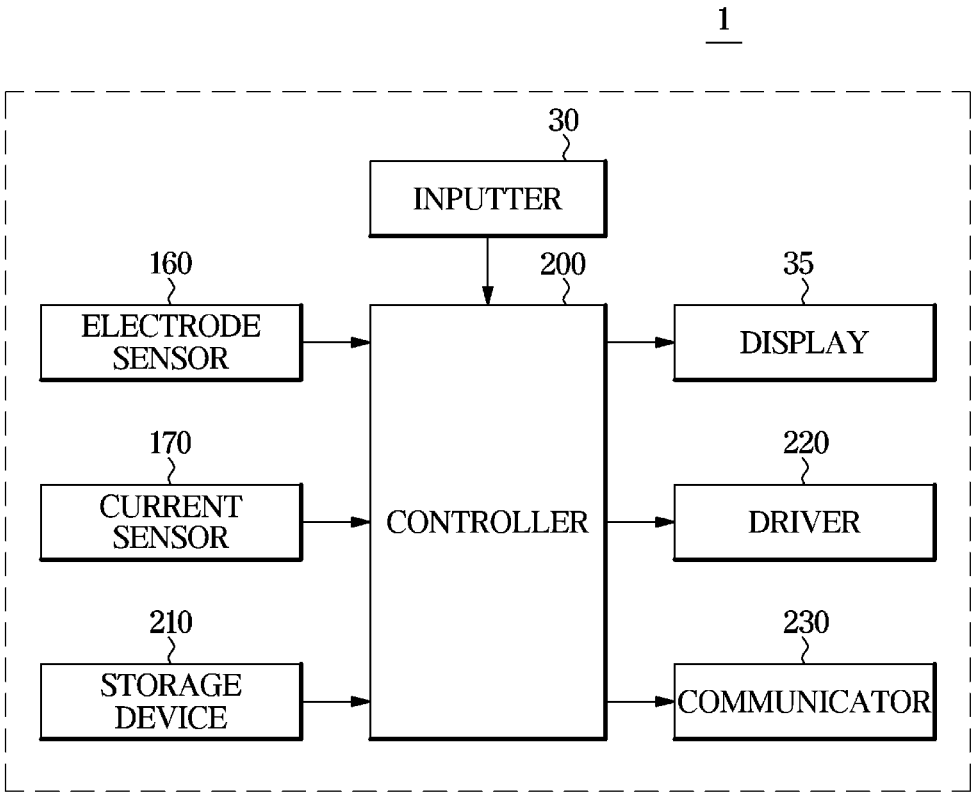
FIG. 4 is a control block diagram of a dryer according to an embodiment.

FIG. 4 is a control block diagram of a dryer according to an embodiment.

The dryer 1 may include the inputter 30 for receiving a user input, the display 35 for displaying a user input and various information related to a drying operation, the electrode sensor 160 for obtaining humidity of a drying material, the current sensor 170 for obtaining a weight of a drying material, a controller 200 for calculating an operation time of the dryer 1 and controlling overall operations of the dryer 1, a storage device 210 for storing the user input and various information related to a drying program, a driver 220 for driving the motor 141, etc. according to a control command from the controller 200, and a communicator 230 for communicating with an external device.

The inputter 30 may provide input means for controlling the dryer 1, and the input means may include a button, a switch, and a graphic user interface. In the dryer 1 according to an embodiment of the disclosure, a dial switch for enabling a user to select one from among a plurality of drying courses and a plurality of buttons for enabling the user to set an option of the selected drying course may be used as the inputter 30. The inputter 30 may receive a control command for the dryer 1 from a user and output the control command as a control signal, and the controller 200 may receive the control signal and control the driver 220 based on the control command.

The display 35 may display a user input and various information related to an operation state of the dryer 1. More specifically, the display 35 may display information about an estimated operation time and a remaining time.

The display 35 may display information about a kind of a drying material, identified by the controller 200, as well as displaying an operation time. For example, the display 35 may display a kind of a drying material as cotton or synthetics.

The electrode sensor 160 may output an electrical signal according to a percentage of water content of a drying material contacting the two electrodes, and the controller 200 may calculate a dryness level of the drying material based on the electrical signal output from the electrode sensor 160.

The current sensor 170 may output a sensed value corresponding to current flowing through the motor 141 when the motor 141 rotates, and the controller 200 may calculate a weight of a drying material based on the sensed value output from the current sensor 170.

The storage device 210 may store setting values and an algorithm for a drying operation for each of a plurality of drying programs. Setting values for a drying operation may be setting values of hardware that needs to operate to perform a drying program according to a user input, and for example, the setting values may be setting values for a rpm of the drum 120, a rotation direction of the motor 141, a driving frequency of the compressor 73, etc. according to a stage of a drying operation and a dryness level of a drying material. The drying program may be a combination of instructions that are executed until operations of the dryer 1 are completed after starting, based on a plurality of drying courses being selectable according to a kind of a drying material and an option set to correspond to a selected drying course.

Also, the algorithm means a logic that detects, while an operation is being performed according to a drying program, a change of an operation state based on sensing values received from sensors, and determines whether to perform the next stage of a drying process according to the change of the operation state. The storage device 21 may store various look-up tables that are referred to by the algorithm. The look-up tables may indicate data sets deduced by experimentally operating the dryer 1. For example, the look-up tables may include measurement values of motor current according to weights of drying materials, the numbers of pulses for each unit time, input through the electrode sensor 160 according to percentages of water content of drying materials, drying time weights (see FIG. 10) according to kinds of drying materials, etc.

The storage device 210 may be implemented as at least one of a non-volatile memory device (for example, a cache, Read Only Memory (ROM), Programmable ROM (PROM), Erasable Programmable ROM (EPROM), Electrically Erasable Programmable ROM (EEPROM), and flash memory), a volatile memory device (for example, Random Access Memory (RAM)), or a storage medium (for example, Hard Disk Drive (HDD) and Compact Disc Read Only Memory (CD-ROM)), although not limited thereto. The storage device 210 may be implemented as a separate chip from a processor described above in regard of the controller 200, or the storage device 210 and the processor may be integrated into a single chip.

The controller 200 may calculate a percentage of water content of a drying material and a weight of the drying material, based on data obtained by the electrode sensor 160 and the current sensor 170, and determine an operation time of the dryer 1 based on the percentage of water content of the drying material and the weight of the drying material.

More specifically, the controller 200 may obtain an initial weight of the drying material based on a magnitude of current flowing through the motor 141, determine a percentage of water content of the drying material based on the number of pulses received from the electrode sensor 160, and identify a kind of the drying material. Identifying the kind of the drying material should be understood as determining whether the kind of the drying material is a kind (a cotton material) capable of absorbing water well or a kind (a synthetic material) incapable of absorbing water well. Also, identifying the kind of the drying material does not mean identifying kinds of a plurality of drying materials separately, and should be understood as determining whether to regard the kind of the drying material as a group, as cotton clothes or as synthetics clothes.

Basically, the controller 200 may measure a weight of a drying material by using data obtained from the current sensor 170, and input the measured weight of the drying material to a look-up table stored in the storage device 210 to obtain an estimated operation time of the dryer 1. At this time, the controller 200 may need to determine a kind of the drying material, which will be input to the look-up table, and the controller 200 may determine a kind of the drying material to be one of a first kind having a high percentage of water content and a second kind having a low percentage of water content by using data obtained from the electrode sensor 160, and input the determined kind of the drying material to the look-up table, thereby obtaining an estimated operation time of the dryer 1.

When a user selects a specific drying course through the inputter 30 and controls the start button 31 of the inputter 30, the dryer 1 may start operating. An entire process until the controller 200 determines operation completion of the dryer 1 and terminates the operation may be largely classified into three stages of a preparing operation, a drying operation, and a cooling operation. In an example of the dryer 1 including the heat pump device, a section for which the compressor 73 of the heat pump device is driven may be considered as a stage of the drying operation, and stages that are performed before and after the drying operation may be considered as stages of the preparing operation and the cooling operation, respectively. The controller 200 may determine, according to a time elapsed after each stage starts or a dried state of a drying material, whether to terminate the corresponding stage and start the next stage. The controller 200 may omit the preparing operation or the cooling operation according to a drying program corresponding to a drying course selected by a user. In the disclosure, a situation in which a drying course programmed to perform all of the preparing operation, drying operation, and cooling operation has been selected is described.

In an embodiment of the disclosure, the controller 200 may determine an estimated operation time in a preparing operation. However, the controller 200 may estimate an operation completion time of the dryer 1 in a drying operation or a cooling operation, within the concept of the disclosure.

Meanwhile, the controller 200 may count the number of pulses received from the electrode sensor 160 to determine a percentage of water content and a dryness level of a drying material. The pulses received by the controller 200 may be pulses output directly from the electrode sensor 160. However, an electrical signal output from the electrode sensor 160 may be input to the controller 200 via a comparator circuit or an amplifier circuit. The electrode sensor 160 should be understood as a term including two electrodes contacting a drying material and a circuit for outputting pulses. That is, the electrode sensor 160 may be a circuit that outputs a pulse in the case in which a magnitude of a voltage measured at the output terminal when the two electrodes are electrified by contacting a drying material is greater than a reference voltage (for example, 5 V). Accordingly, the controller 200 may compare the number of pulses received for a preset time with a reference value to thereby determine a percentage of water content and a dryness level of a drying material.

The controller 200 may perform a preparing operation for a predefined time according to a drying program selected by a user, and calculate a time at which an operation of the dryer 1 terminates, in the preparing operation. The controller 200 may control the display 35 to display the calculated time as a time remaining until drying completion, and control the display 35 to display information about a kind of a drying material together with time information. Meanwhile, the preparing operation may be considered to be completed at a time at which the time remaining until drying completion is displayed on the display 35.

Figure 5:
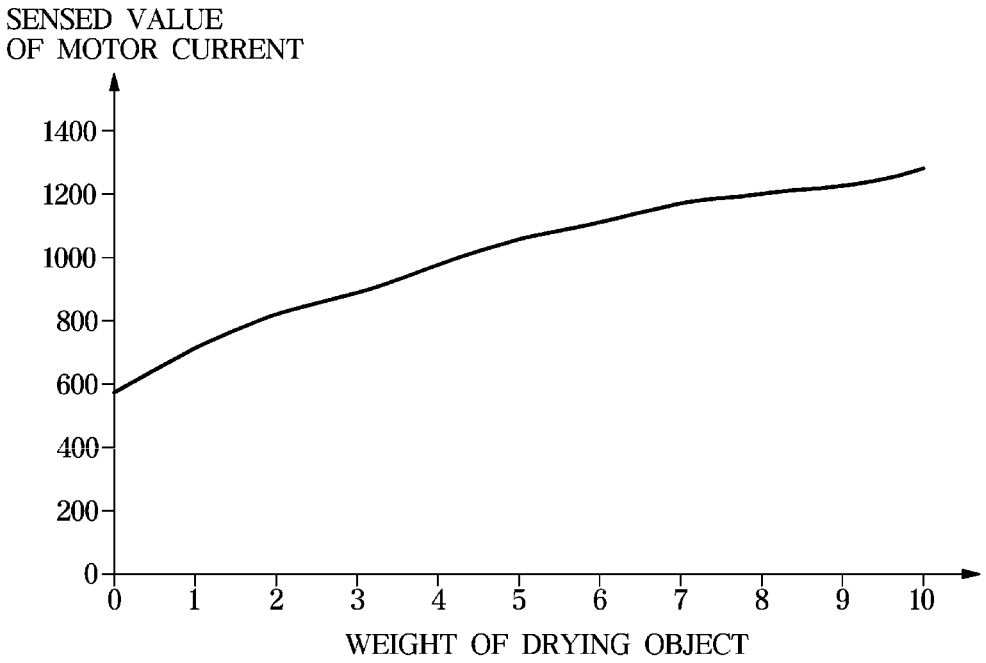
FIG. 5 shows a correlation between weights of a drying material and sensed values of motor current.

A process of measuring a weight of a drying material and identifying a kind of the drying material will be described in detail with reference to FIGS. 5 to 7. FIG. 5 shows a correlation between weights of a drying material and sensed values of motor current, FIG. 6 shows the numbers of pulses output from the electrode sensor with respect to weights of drying materials according to kinds of the drying materials, and FIG. 7 shows measurement values of percentages of water content upon washing completion according to kinds of drying materials.

Referring to FIG. 5, a sensed value of motor current is proportional to a weight of a drying material. A sensed value of motor current means a value obtained by converting a value of current flowing through the motor 141 being driven at preset RPM into a digital signal. For example, in FIG. 5, a current value corresponding to a sensed value 1000 of motor current may be 0.3 A, and the greater current value may result in the greater sensed value of motor current. Also, in a graph of FIG. 5, a sensed value of motor current may be an average value of sensed values of motor current measured for 20 seconds while the motor 141 or the drum 120 rotates at 2080 RPM. A sensed value of motor current may be obtained by integrating values sensed for a preset time or by averaging values sampled for a preset time. In the graph of FIG. 5, the sensed value of motor current may be a value obtained by averaging 200 sensed values of motor current sampled per 100 msec (0.1 sec) for 20 seconds.

A weight of a drying material may be an initial weight value of the drying material before a drying operation is performed. For example, when a sensed value of motor current is 800, a weight of a drying material may be estimated as about 2 Kg. In this way, the controller 200 may estimate a weight of a drying material based on a sensed value of motor current. At this time, the controller 200 may determine a weight of a drying material based on the look-up table stored in the storage device 210, or based on a proportional expression for sensed values of motor current and weights of a drying material.

Figure 6:
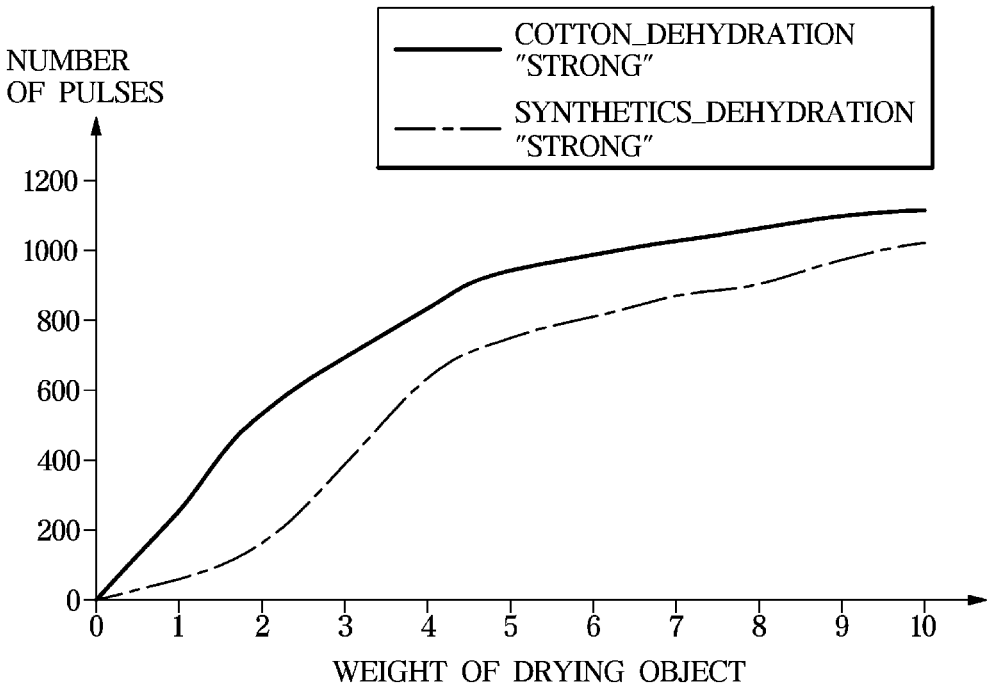
FIG. 6 shows a correlation between kinds of drying materials and sensed values of drying material current.

FIG. 6 shows weights of drying materials with respect to the numbers of pulses input from the electrode sensor 160 to the controller 200 for a preset time while the drum 120 rotates at preset RPM, when cotton clothes and synthetics clothes washed at dehydration strength 'strong' and being in a wet state are put in the drum 120 of the dryer 1.

More specifically, a graph of FIG. 6 shows experimental values obtained by counting the numbers of pulses received from the electrode sensor 160 for 50 seconds in the case of rotating the motor 141 or the drum 120 at 2080 RPM while changing weights of drying materials. As seen from the graph of FIG. 6, the number of pulses received for a drying material of cotton having a high percentage of water content is more than that received for clothes of synthetic fibers having a low percentage of water content. That is, the number of pulses received with respect to cotton clothes having a weight of 3 Kg is 700, whereas the number of pulses received with respect to synthetics clothes having the same weight is 300. However, at greater weights of drying materials, the numbers of pulses received by the controller 200 according to kinds of the drying materials make smaller differences. This means that, when a drying material is 4 Kg or more, it is difficult to correctly identify a kind of the drying material based on a value detected by the electrode sensor 160.

FIG. 7 shows data obtained by measuring degrees of dampness, that is, percentages of water content with respect to cotton clothes and synthetics clothes after washing, in the case of washing the cotton clothes and the synthetics clothes while changing dehydration strengths. Generally, cotton has a higher percentage of water content than synthetics. A percentage of water content of cotton clothes, measured after the cotton clothes are washed at dehydration strength 'strongest', is 48% which means that 48% of a measured weight of the cotton clothes is a weight of water. This means that cotton clothes washed at the dehydration strength 'strongest' holds more water of twice or more than synthetics clothes washed at the same condition.

As such, the controller 200 may primarily estimate an operation time of the dryer 1 by summing a time to be consumed for a drying operation which will be performed after the preparing operation and a time to be consumed for a cooling operation, based on the measured weight of the drying material, and apply a weight obtained based on the number of pulses received from the electrode sensor 160 to the primarily estimated operation time of the dryer 1 to finally obtain an operation time of the dryer 1. The operation time of the dryer 1 may be displayed on the display 35. However, a calculation logic described above may be not necessarily performed by stage. When the controller 200 is actually configured with a plurality of microcomputers, etc., the controller 200 may input a sensed value of motor current and the number of pulses, as input values, to the look-up table stored in the storage device 210, thereby calculating an operation time at once.

The driver 220 may receive a control command from the controller 200, and include an inverter and a motor to output an instruction value to the motor 141 connected to the drum 120. Also, the driver 220 may apply power to the fan 153 in response to a control command from the controller 200, and adjust a driving frequency of the compressor 73 in response to a control command from the controller 200 to change an output capacity of the compressor 73.

The communicator 230 may be a communication circuit connected to a network, and communicate with an external server. A user may execute an application installed in a terminal to check an operation state of the dryer 1 through the server. The communicator 230 may receive a control command transmitted from the user's terminal through the server and input the control command to the controller 200, so that the dryer 1 may be controlled remotely.

So far, the individual components of the dryer 1 and operations of the individual components have been described in detail. Hereinafter, a method, performed by the dryer 1, of displaying a drying operation time will be described in detail.

Figure 8:
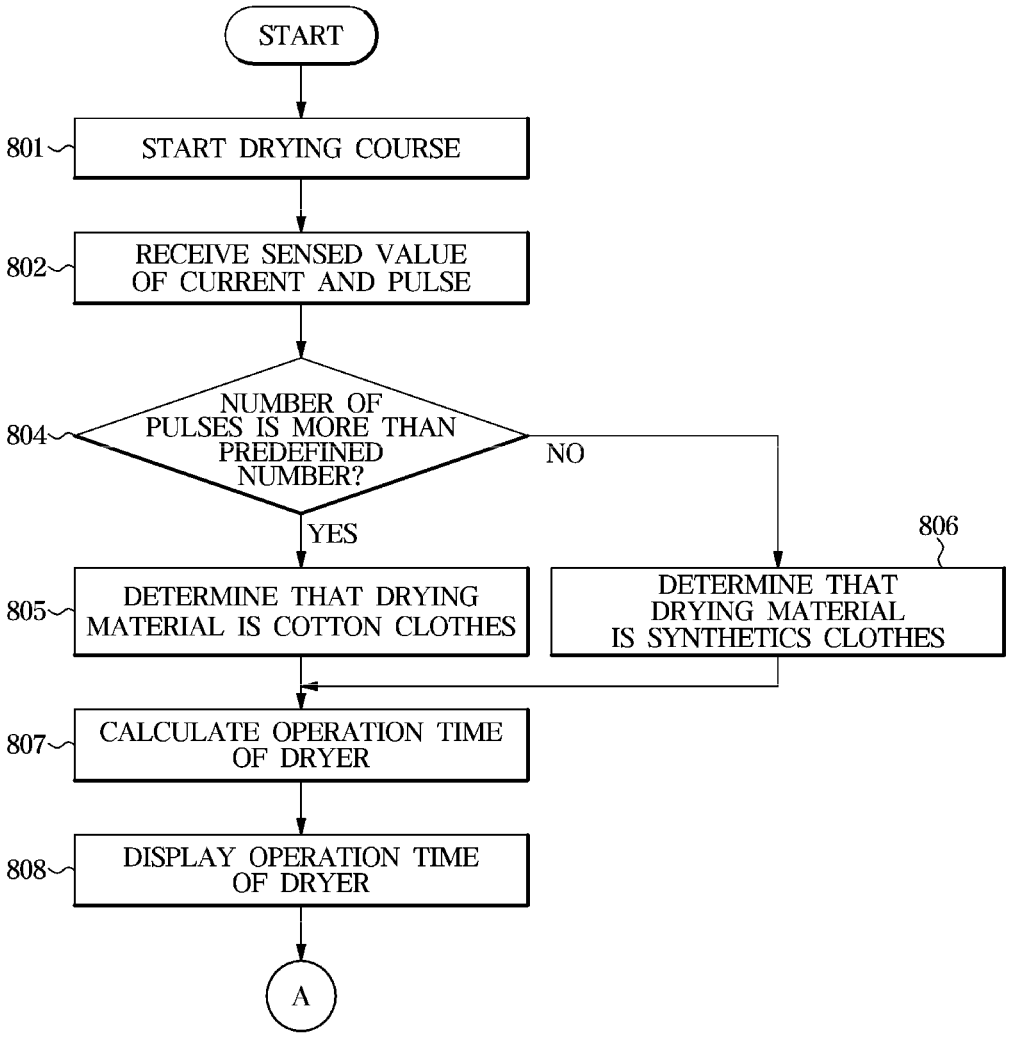
FIG. 8 is a flowchart illustrating a method for controlling a dryer according to an embodiment.
Figure 9:
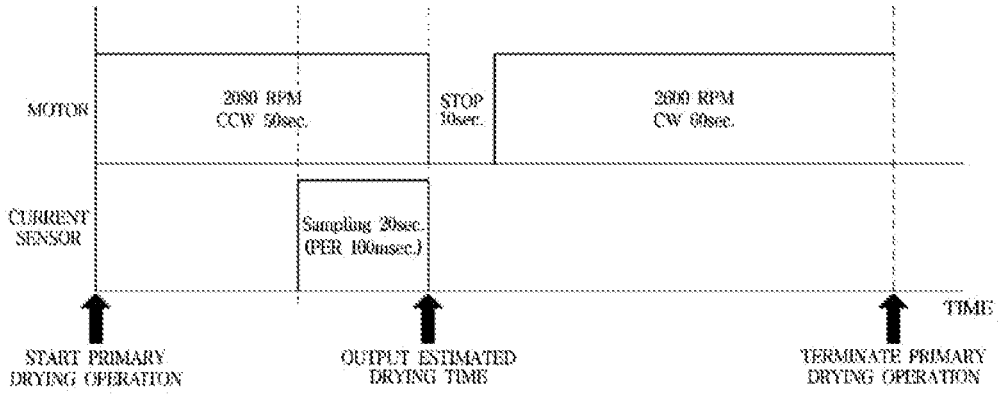
FIG. 9 is a view for describing an operation of calculating a weight of a drying material in more detail, referred to in FIG. 8.

FIG. 8 is a flowchart illustrating a method for controlling a dryer according to an embodiment, and FIG. 9 is a view for describing a method for calculating a weight of a drying material in more detail, referred to in FIG. 8.

The controller 200 may start operating in response to a start command of a specific drying course selected through the inputter 30, in operation 801. The controller 200 may identify the selected specific drying course, and control the driver 220 to perform a preparing operation.

The controller 200 may calculate a weight of a drying material and a percentage of water content of the drying material while the preparing operation is performed, in operation 802. The controller 200 may calculate the percentage of water content of the drying material after calculating the weight of the drying material, or may calculate the weight of the drying material after calculating the percentage of water content of the drying material. Also, the controller 200 may calculate the percentage of water content of the drying material and the weight of the drying material at the same time. To calculate the weight of the drying material, the controller 200 may control the motor 141 to rotate the drum 120 at preset RPM in one direction for a preset time.

For example, referring to FIG. 9, the controller 200 may control the motor 141 to rotate the drum 120 at 2080 RPM in a counterclockwise direction for 50 seconds, and receive a sensed value of motor current corresponding to a value of current flowing through the motor 141 from the current sensor 170. In the disclosure, a rotation direction of the drum 120 is defined as a direction in which the drum 120 rotates when the dryer 1 is seen from the front. According to the disclosure, the controller 200 may calculate a weight of a drying material by using an average value of sensed values of motor current received for 20 seconds from when 30 seconds elapse after the preparing operation starts. The controller 200 may record a value received from the current sensor 170 per 100 msec from when 30 seconds elapse after the preparing operation starts, and obtain an average value of 200 sensed values of motor current accumulatively recorded to calculate a weight of the drying material.

Also, the controller 200 may calculate a percentage of water content of the drying material while the drum 120 rotates in the counterclockwise direction, independently from operation of calculating the weight of the drying material. According to the disclosure, the controller 200 may count the number of pulses received from the electrode sensor 160 while rotating the drum 120 to perform a preparing operation, calculate a percentage of water content of the drying material based on the number of pulses accumulatively counted until the drum 120 stops rotating after 50 seconds, and identify a kind of the drying material.

For example, when the number of pulses received from 50 seconds is 700 or more in operation 804, the controller 200 may determine that the drying material is cotton clothes, in operation 805, and, when the number of pulses is 700 or less, the controller 200 may determine that the drying material is synthetics clothes, in operation 806.

After the controller 200 determines a kind of the drying material, the controller 200 may calculate an operation time of the dryer 1, in operation 807, and control the display 32 to display the calculated operation time of the dryer 1, in operation 808.

The controller 200 may calculate a time at which the selected specific drying course terminates based on the calculated weight of the drying material and the percentage of water content of the drying material, and output information about the calculated time on the display 35. Simultaneously, the controller 200 may output information about the kind of the drying material identified based on the percentage of water content of the drying material to the display 32.

Optionally, the controller 200 may control the communicator 230 to transmit the information about the calculated time and the information about the kind of the drying material to an external server, and a user may check the time at which the drying course is completed and the information about the kind of the drying material through an application installed in a terminal.

Meanwhile, according to the disclosure, in the preparing operation, the drum 120 may rotate at 2080 RPM in the counterclockwise direction for 50 seconds, and then stop rotating. After 10 seconds elapse, the drum 120 may change its rotation direction and start rotating in the clockwise direction. In the following drying operation and cooling operation, the drum 120 may rotate in the clockwise direction. In the disclosure, a process of calculating an operation time of the dryer 1 based on a weight of a drying material and a percentage of water content of the drying material may be performed while rotating the drum 120 in the opposite direction of a rotation direction of the drum 120 for performing a drying operation.

The disclosure may adopt a configuration of rotating the drum 120 and the fan 153 with a driving force provided from the motor 141, wherein a normal blowing force may be generated by the fan 153 only when the drum 120 rotates in the clockwise direction, and when the drum 120 rotates in the counterclockwise direction, the fan 153 may also rotate in the reverse direction so as to generate no blowing force. It may be also possible to calculate a weight of a drying material and a percentage of water content of the drying material while rotating the drum 120 in the clockwise direction. However, in this case, because air is supplied to the inside of the drum 120 by the fan 153, there may be probability that pulses input from the electrode sensor 160 to the controller 200 will be mixed with noise, resulting in an inaccurately calculated percentage of water content of a drying material.

The controller 200 may rotate the drum 120 in the counterclockwise direction for 50 seconds, then stop the drum 120 for 10 seconds, rotate the drum 120 in the clockwise direction for 1 minute, and then control the driver 220 to drive the compressor 73. As described above, in the disclosure, it is, for convenience of description, defined that a drying operation starts from a time at which the compressor 73 starts being driven. However, it may be also defined that a drying operation starts from a time at which the drum 120 changes its rotation direction to rotate in the clockwise direction.

Hereinafter, a logic for calculating an operation time of the dryer 1 by using a weight of a drying material and a percentage of water content of the drying material, calculated by the controller 200, will be described in detail. The operation time of the dryer 1 means a time taken until the dryer 1 terminates operating after the drum 120 stops rotating in the counterclockwise direction. The operation time of the dryer 1 may be understood as a time remaining until drying completion. A method for calculating an operation time of the dryer 1 according to the disclosure will be described by using a look-up table shown in FIG. 10 as an example.

First, the controller 200 may compare the number of pulses received from the electrode sensor 160 while the drum 120 rotates in the counterclockwise direction, with a reference value, to determine whether to process a drying material as cotton clothes or as synthetics clothes. For example, when the reference value is 700, the controller 200 may determine the drying material to be cotton when the number of pulses counted for 50 seconds is 700 or more, and when the number of pulses counted for 50 seconds is less than 700, the controller 200 may determine the drying material to be synthetics. However, determining whether the number of pulses is more than or equal to, less than or equal to, more than, or less than a reference value may be an example, and a case in which the number of pulses is more than 700 and a case in which the number of pulses is less than or equal to 700 may be divided.

Then, an average value of 200 values obtained by sampling sensed values of motor current received from the current sensor 170 may be obtained, and the average value may be mapped to the look-up table to calculate a weight of the drying material. In the disclosure, a case in which the average value is obtained as 1000 will be described as an example. When the average value of the sensed values of motor current is 1000, the average value may correspond to a weight of 3 Kg to 4 Kg on the look-up table. When the count number of pulses is 600, the corresponding drying material may correspond to synthetics clothes. Therefore, a time resulting from subtracting 40 minutes from a reference time may be calculated as an operation time of the dryer 1. In this case, the reference time may be 129 minutes calculated with respect to cotton clothes corresponding to a weight 4 Kg to 5 Kg of a drying material, and accordingly, an operation time of the dryer 1 may be calculated as 89 minutes. Meanwhile, when the number of pulses counted by the controller 200 in the preparing operation is 800, the drying material may correspond to cotton clothes, and in this case, 109 minutes calculated by subtracting 20 minutes from the reference time may be calculated as an operation time of the dryer 1.

Accordingly, when the operation time of the dryer 1 is calculated, the controller 200 may display the calculated operation time of the dryer 1 on the display 35, count a time elapsed from when the operation time of the dryer 1 is displayed, subtract the count time from the operation time of the dryer 1 to update the operation time of the dryer 1, and display the updated operation time of the dryer 1 on the display 35.

As seen from FIG. 9, when the operation time of the dryer 1 according to the disclosure, estimated by the dryer 1, is displayed on the display 35, the motor 141 may be not driven, and accordingly, the drum 120 may rotate in the counterclockwise direction by inertia or be in a stopped state. Because the operation time of the dryer 1 has been calculated by the controller 200, the drum 120 may no longer rotate in the counterclockwise direction. Therefore, when the drum 120 stops rotating to change a rotation direction, the operation time of the dryer 1 may be displayed on the display 35.

Thereafter, the controller 200 may control the driver 220 to rotate the drum 120 in the clockwise direction, and control the driver 220 to operate the compressor 73 after 1 minute from when the drum 120 starts rotating, thereby starting a drying operation. The drying operation may be a process of supplying hot air to the drying material to substantially dry the drying material, and the drying operation may be performed based on the operation time of the dryer 1 calculated in the preparing operation and the kind of the drying material determined in the preparing operation.

Figure 11:
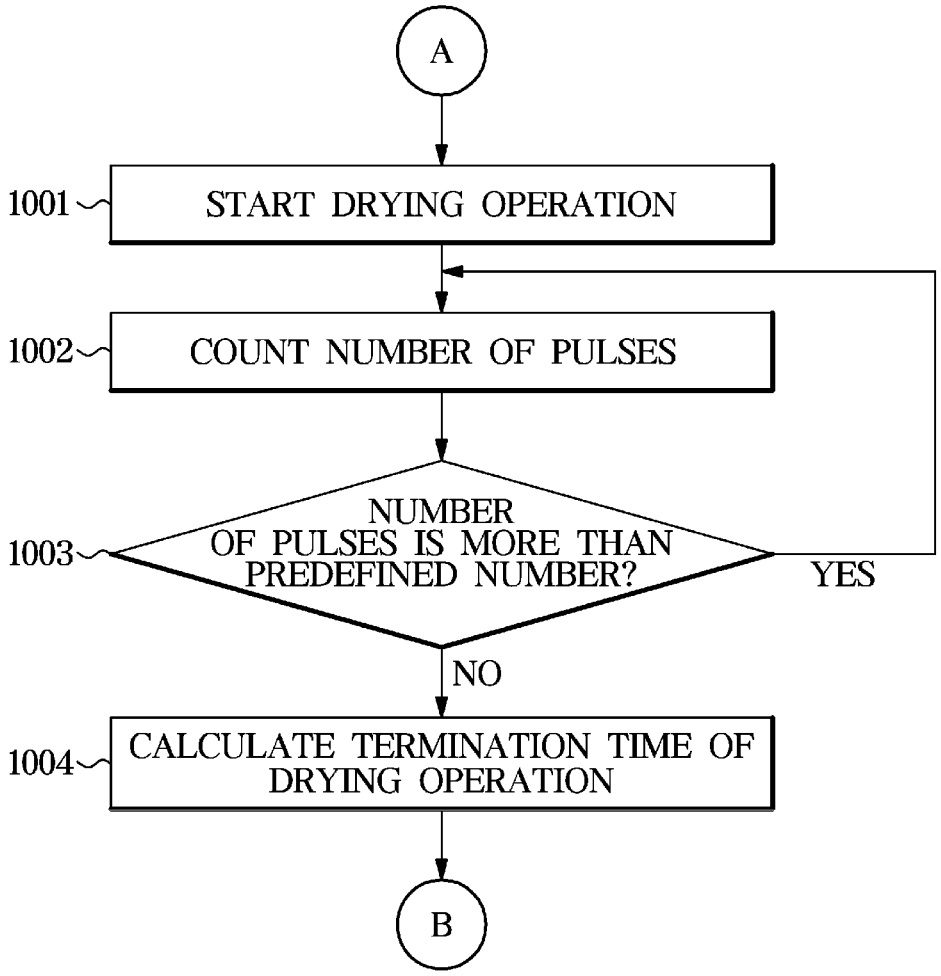
FIG. 11 is a flowchart illustrating a method for controlling a dryer according to an embodiment.
Figure 13:
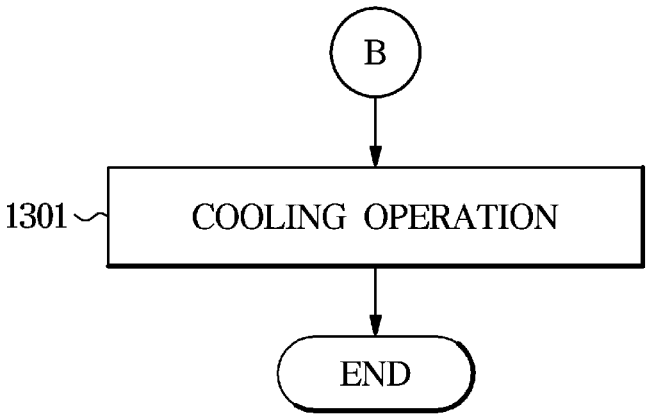
FIG. 13 is a flowchart illustrating a method for controlling a dryer according to an embodiment.

FIG. 11 is a flowchart illustrating a method for controlling a dryer according to an embodiment. Hereinafter, the method will be described by referring together to FIGS. 11 and 12.

When 1 minute elapses from when the drum 120 starts rotating in the clockwise direction, the controller 200 may drive the compressor 73 to start a drying operation, in operation 1101.

Generally, cotton requires a longer time for a drying operation than synthetics. Therefore, according to the disclosure, an operation time of the dryer 1 for a drying operation may be corrected based on a kind of a drying material determined in the preparing operation.

In this case, a correction time that is applied to a drying operation may be obtained by using a look-up table shown in FIG. 12. It is seen from FIG. 12 that different correction factors are applied according to kinds of drying materials.

The controller 200 may count the number of pulses received from the electrode sensor 160 while performing the drying operation, in operation 1102. In operation 1102, the controller 200 may detect a dryness level of the drying material based on the count number of pulses, by a method that is similar to a method of detecting a percentage of water content of a drying material by using the number of pulses counted in a preparing operation. The controller 200 may repeatedly count the number of pulses received for a predefined time, while performing the drying operation. According to the disclosure, the controller 200 may repeatedly perform a process of counting the number of pulses received for 1 minute, recording the count number of pulses, then counting the number of pulses received for the next 1 minute, and recording the count number of pulses.

When the number of pulses received for a preset time is less than a predefined number, in operation 1103, the controller 200 may calculate a termination time of the drying operation, in operation 1104. In contrast, when the number of pulses received for the preset time is more than the predefined number, in operation 1103, the controller 200 may again count the number of pulses received from the preset time. In the disclosure, a time at which the controller 200 determines that the number of pulses received for the preset time while a drying operation is performed is less than the predefined number may be defined as a time at which a dryness level is detected. That is, when the controller 200 determines that an arbitrary time has elapsed from when a dryness level is detected, the controller 200 may terminate the drying operation, wherein the arbitrary time may be determined when the dryness level is detected. The predefined number that is compared with the number of pulses received for the preset time may change according to a kind of a drying material. For example, cotton may be based on 10, and when the number of pulses received for 1 minute is less than 10, it may be determined that the cotton has been dried to some degree. Meanwhile, synthetics may be based on 3, and when the number of pulses received for 1 minute is less than 3, it may be determined that the synthetics have been almost dried.

Also, when a dryness level of a drying material is determined based on the number of pulses, there may be a case that the number of pulses is less counted under a certain environment although the drying material has actually been not sufficiently dried. To provide against the case, in the disclosure, an algorithm for determining a time at which an event that the number of pulses counted for the preset time is less than the reference number occurs three times consecutively to be a time at which a dryness level is detected will be described.

When a kind of a drying material is determined to be cotton, the controller 200 may determine a time at which an event that the number of pulses counted for 1 minute is less than 10 is detected three times consecutively to be a detection time of a dryness level, and correct an operation time of the dryer 1.

At this time, the controller 200 may obtain a time (drying time T) taken until a dryness level is detected after the drying operation starts, and determine a correction factor corresponding to the drying time T, based on the look-up table shown in FIG. 12. When a time resulting from multiplying the drying time T by the correction factor elapses from when the dryness level is detected, the controller 200 may terminate the drying operation. For example, when a kind of a drying material is determined to be cotton and 70 minutes have elapsed until a dryness level is detected after a drying operation starts, a correction factor may be determined to be 0.14, an additional drying time of 9.8 (70 minutes×0.14) minutes may be determined, and accordingly, when 9.8 minutes elapse from when the drying time is detected, the controller 200 may terminate the drying operation.

When a kind of a drying material is determined to be synthetics, a dryness level detection time may be determined in the case in which a condition in which an event in which the number of pulses counted for 1 minute is less than 3 occurs three times consecutively is satisfied. Also, when a time taken until a dryness level detection time from when a drying operation starts is 90 minutes, 90 minutes may be multiplied by a correction factor 0.1 based on the look-up table shown in FIG. 12 to obtain an additional drying time of 9 minutes, and the additional drying time of 9 minutes may be applied. Therefore, when 9 minutes elapse from the dryness level detection time, the controller 200 may terminate the drying operation.

When the controller 200 determines termination of the drying operation, the controller 200 may terminate driving of the compressor 73 to stop heating air, and perform a cooling operation while rotating the fan 153 and the drum 120, in operation 1301.

The cooling operation may be understood as a process of lowering temperature of the drying material to prevent a user from taking out the drying material heated by hot air. Accordingly, when it is determined that temperature of air discharged from the drum 120 is lower than or equal to preset temperature, when it is determined that a predefined time for the cooling operation has elapsed, or when both the two conditions are satisfied, the controller 200 may determine termination of the cooling operation.

When the cooling operation terminates through the above-described process, the controller 200 may stop driving the drum 120 and the fan 153, unlock the door 130, and output sound informing operation termination of the dryer 1, thereby completing the drying course of the dryer 1.

Meanwhile, the disclosed embodiments may be implemented in the form of a recording medium that stores commands executable by a computer. The commands may be stored in the form of a program code, and when executed by a processor, the commands may create a program module to perform operations of the disclosed embodiments. The recording medium may be implemented as a computer-readable recording medium.

The computer-readable recording medium may include all kinds of recording media storing commands that can be interpreted by a computer. For example, the recording media may include Read Only Memory (ROM), Random Access Memory (RAM), a magnetic tape, a magnetic disc, flash memory, an optical data storage device, etc.

So far, the disclosed embodiments have been described with reference to the accompanying drawings. It will be apparent that those skilled in the art can make various modifications thereto without changing the technical spirit and essential features of the disclosure. Thus, it should be understood that the disclosed embodiments are merely for illustrative purposes and not for limitation purposes.

What is claimed is:

1. A dryer comprising:

a main body including a user interface;

a drum to accommodate a material to be dried;

a motor configured to provide a rotation force to the drum;

a heat pump device including a compressor, and configured to heat air to be supplied to the drum;

an electrode sensor including a pair of electrodes, and configured to output a pulse when the pair of electrodes contact the material to be dried;

a current sensor configured to output a sensed value corresponding to a magnitude of a current flowing through the motor; and a controller configured to receive a drying course selected through the user interface, and output a control signal to control the motor and the compressor, wherein the controller is configured to:

receive pulses from the electrode sensor and the sensed value from the current sensor, while controlling the motor to rotate the drum without driving the compressor, determine an estimated time for the drying course selected to be completed, based on the pulses and the sensed value, and control the user interface to display the estimated time.

2. The dryer of claim 1, wherein the controller is further configured to control the user interface to display the estimated time, while the compressor is not driven and the motor is not rotated.

3. The dryer of claim 2, wherein the controller is further configured to identify a type of the material to be dried based on a number of pulses received from the electrode sensor, and control the user interface to display information about the type of the material to be dried.

4. The dryer of claim 1, wherein the controller controls the motor to rotate the drum in a first direction, and the controller is further configured to control, after the estimated time is displayed, the motor to rotate the drum in a second direction that is opposite to the first direction.

5. The dryer of claim 1, wherein the controller is further configured to control the user interface to display the estimated time with a delay after the drying course is selected through the user interface.

6. The dryer of claim 1, wherein the controller is further configured to drive, after the estimated time is displayed on the user interface, the compressor.

7. The dryer of claim 4, wherein the controller is further configured to drive, when a preset time elapses after the controller controls the motor to rotate the drum in the second direction, the compressor.

8. The dryer of claim 4, wherein the controller is further configured to control the motor such that revolutions per minute (rpm) of the motor when the drum rotates in the second direction is greater than rpm of the motor when the drum rotates in the first direction.

9. The dryer of claim 1, further comprising:

a communicator configured to communicate with an external server, wherein the controller is further configured to control the communicator to transmit the estimated time to the external server.

10. The dryer of claim 3, wherein the controller is further configured to control the user interface to display the information about the type of the material to be dried together with the estimated time.

11. A control method of a dryer, comprising:

receiving a request to start a drying operation corresponding to a drying course selected by a user;

receiving, while a drum provided to accommodate a material to be dried rotates, a sensed value output from a current sensor, the sensed value corresponding to current flowing through a motor to rotate the drum;

counting, while the drum rotates, a number of pulses output from an electrode sensor, the pulses being output when a pair of electrodes of the electrode sensor contact the material to be dried;

determining an estimated time for the selected drying operation to terminate, based on the received sensed value and the counted number of pulses; and control a user interface to display the estimated time.

12. The control method of claim 11, further comprising:

identifying a type of the material to be dried based on the counted number of pluses; and controlling the user interface to display information about the type of the material to be dried.

13. The control method of claim 12, further comprising:

controlling the user interface to display the information about the type of the material to be dried together with the estimated time, when displaying the estimated time.

14. The control method of claim 11, wherein the drum rotates in a first direction when the sensed value is received, and the control method further comprises:

controlling, after the estimated time is displayed, the drum to rotate in a second direction that is opposite to the first direction.

15. The control method of claim 11, further comprising:

controlling the drum to stop rotating after the drum is controlled to rotate for a preset time, and controlling the user interface to display the estimated time when the drum stops.

* * * * *